US009250566B2

(12) United States Patent
Foley

(10) Patent No.: US 9,250,566 B2
(45) Date of Patent: Feb. 2, 2016

(54) END SEAL WITH INSERT FOR CHAMBERED DOCTOR BLADE ASSEMBLY

(71) Applicant: Anthony Foley, Templeton, CA (US)

(72) Inventor: Anthony Foley, Templeton, CA (US)

( * ) Notice: Subject to any disclaimer, the term of this patent is extended or adjusted under 35 U.S.C. 154(b) by 0 days.

(21) Appl. No.: 14/612,851

(22) Filed: Feb. 3, 2015

(65) Prior Publication Data

US 2015/0286161 A1 Oct. 8, 2015

Related U.S. Application Data

(60) Provisional application No. 61/974,192, filed on Apr. 2, 2014.

(51) Int. Cl.
*G03G 15/08* (2006.01)
*B41F 31/02* (2006.01)

(52) U.S. Cl.
CPC ..... *G03G 15/0817* (2013.01); *B41F 31/027* (2013.01)

(58) Field of Classification Search
CPC combination set(s) only.
See application file for complete search history.

(56) References Cited

U.S. PATENT DOCUMENTS 5,057,868 A * 10/1991 Sekino et al. ..... 399/105
2012/0049465 A1* 3/2012 Foley ..... 277/500

FOREIGN PATENT DOCUMENTS

DE 20 2009 013643 U1 3/2011
EP 2 425 972 A2 3/2012

* cited by examiner

*Primary Examiner* — Clayton E Laballe
*Assistant Examiner* — Jas Sanghera
(74) *Attorney, Agent, or Firm* — Woods Oviatt Gilman LLP; Katherine H. McGuire, Esq.

(57) ABSTRACT

An end seal for removable attachment to a doctor blade assembly is provided. The end seal comprises a seal body having a bottom wall, opposite first and second sidewalls and a top edge configured to include a radius adapted to seal against a roller surface. At least one abrasion resistant insert is integrally secured within the seal body. The insert includes a bottom wall, opposite first and second sidewalls and a top edge configured to coincide with the body top edge so as to seal against the roller surface. The abrasion resistant insert may further include one or more holes wherein the seal body impregnates the holes. One or both of the opposite first and second insert sidewalls and/or the insert bottom wall may reside within and be encapsulated by the seal body. The abrasion resistant insert may be constructed of polytetrafluoroethylene, a perfluoroalkoxy alkane or fluorinated ethylene propylene.

35 Claims, 3 Drawing Sheets

END SEAL WITH INSERT FOR CHAMBERED DOCTOR BLADE ASSEMBLY

BACKGROUND OF THE INVENTION

The present invention generally relates to doctor blade assemblies which define an enclosed fluid reservoir for applying fluid to a rotating roller, and more particularly relates to an abrasion resistant end seal used to seal the opposite ends of the fluid reservoir, the end seal including an integral abrasion resistant insert which engages with the roller and where the insert may serve as a rotary doctor/metering blade.

Enclosed doctor blade assemblies are used extensively in machinery utilizing a rotating roller that picks up fluid from a reservoir and deposits the fluid onto another surface located opposite the doctor blade assembly. Examples of such machinery include rotary printing units such as flexographic printing machines. Such enclosed doctor blade assemblies can also be utilized for the application of varnish, adhesives and various specialty coatings, for example. In a flexographic printing station, the enclosed doctor blade assembly delivers ink to the surface of an engraved roller, often referred to as the anilox roll. The surface of the anilox roller contains engraved microscopic cells that carry and deliver a pre-determined quantity of ink to the surface of the printing plate.

The enclosed doctor blade assembly is intended to form an intimate seal with the surface of the anilox roller. The top and bottom, longitudinal surfaces of the assembly are sealed by means of two doctor blades. The doctor blades are mounted to the reservoir and positioned in parallel, spaced relation to each other and are directed at strategic angles to engage the free edges of the doctor blades with the surface of the anilox roller. The doctor blades extend the full length of the anilox roller. The function of each doctor blade is determined by the rotational direction of the anilox roller with one blade metering the ink or other fluid from the surface of the anilox roller while the other blade simply acts in an ink containment role, holding ink within the reservoir (see, for example, U.S. Pat. No. 5,125,341). In such enclosed doctor blade assemblies, the reservoir and doctor blades contain the fluid except at the opposite ends thereof which are open and must be closed with specially configured seals to completely enclose the reservoir and ensure the fluids (e.g., printing ink and cleaning solutions) do not unintentionally leak from the enclosed fluid reservoir. The part of the seal that faces the radial surface of the anilox roller comes into direct contact with the surface of the anilox roller when the enclosed doctor blade assembly is put into operation. The remaining surfaces of the seal are in contact with the inner surfaces of the two doctor blades and the frame forming the reservoir of the enclosed doctor blade assembly.

Traditional doctor blade assembly end seals are manufactured from compressible foam and rubber materials which are very susceptible to uncontrolled deformation and dislodgement from the ideal operating position relative to the surface of the anilox roller, particularly when exposed to changes in the internal operating pressure of the enclosed fluid reservoir during normal operation, as well as the inherent mechanical drag applied by the rotation of the anilox roller, especially at elevated press speeds. Once dislodged from the correct operating position the normal life expectancy of the seal is shortened considerably and ink leakage starts almost immediately. Even if such a seal is not completely dislodged from the fluid reservoir frame, even minor unintended deformation or seal movement within the frame immediately leads to premature wear and some degree of unwanted leaking of the ink or other fluid from within the enclosed ink reservoir. Press operators are then forced to stop the machine production to change/replace the worn or dislodged seals. There is also excessive cost associated with the wasted ink as well as additional cleaning of the machine and various press components that are exposed to the leaking ink.

The surface of the anilox roller is quite hard (e.g., 1250-1300 Hv (Vickers scale; equivalent to Shore C +70) and abrasive due to the fluid-holding cells engraved into it which act to coat fluid onto the roller surface as it rotates through the fluid reservoir. As such, the end seals are exposed to significant abrasive wear as the anilox roller rotates, particularly at very high speeds which result in a proportional increase in the COF (coefficient of friction) and mechanical stress applied to the seals. New servo-drive, gearless flexographic presses have dramatically increased the machine production speeds that can be obtained. As the rotational speed of the anilox roller is increased, there is a proportional decrease in the life-expectancy of the surface of the seals in contact with it. Thus, as machine speeds have continued to increase, the industry has seen the prior art seals wearing out or otherwise failing faster than ever before.

Besides being subjected to abrasive wear, the end seals are also exposed to various levels of hydraulic pressure applied by the reservoir fluids (e.g., the printing ink and cleaning solutions) that are pumped into and out of the reservoir during normal operation of the press. The wear rate of the surface of the seals in contact with the anilox roller is thus directly proportional to the anilox roller surface abrasiveness, hydraulic pressure applied by the reservoir fluids, and the speed at which the anilox roller is turning (rpm's). This rapid wear of the seals results in a considerable decrease in productivity due to the press operator having to frequently stop the printing press to replace worn, dislodged or leaking end seals in each of the print stations. A typical gearless flexographic press will have between eight and ten print stations having a pair of seals in each. In addition, modern servo presses are typically equipped with an automatic wash-up feature that facilitates very quick transition to the next print job. During the switch from one print job to the next the automatic wash-up cycle is initiated and any ink that remains in the enclosed ink reservoir from the completed job is extracted using suction and then charged (pumped) with cleaning solution. This cleaning cycle exposes the seals to varying degrees of negative followed by positive hydraulic pressure as ink is removed and cleaning solution is pumped/sprayed through nozzles and circulated within the reservoir of the enclosed doctor blade assembly. During the ink extraction stage and delivery of cleaning solution to the enclosed ink reservoir, a significant change in the internal operating pressure of the ink reservoir occurs due to the suction required to remove the left-over ink as well as the cleaning solution once the cleaning cycle is complete. This change in internal pressure within the enclosed ink reservoir has been known to dislodge one or both the end seals from their ideal operating position, leaving the seals incorrectly oriented relative to the surface of the anilox roller. If the machine is then operated with the end seals in an incorrect orientation relative to the curved surface of the anilox roller, the end seal wears rapidly (similar to having unbalanced tires on a car) which, if not caught by the operator, results in a loss of intimate contact with the surface of the anilox roller which in turn allows ink to enter the area where the seal makes contact with the surface of the anilox roller. Once the printing ink enters this area (between the surface of the seal facing the roller and the anilox roller) the ink starts to dry which then adds to the rate of abrasive wear on the seal. Compounding the problem is that the new gearless press technology runs at 2-3 times the production speed of conventional geared presses. As such, there is a significant increase in the level of mechanical stress applied to the end seals in the rotary direction where it makes contact with the surface of the anilox roller.

There thus remains a strong need in the industry for enclosed doctor blade end seals which are much more durable and failure resistant than the end seals which have been used to date.

SUMMARY OF THE INVENTION

The present invention addresses the above described problems with prior art end seals by providing an end seal for an enclosed doctor blade assembly with the end seal having an abrasion resistant insert which improves the structural integrity of the end seal while also exhibiting good sealing properties and extended end seal operational life. The present invention addresses the problems of prior art end seals by providing an end seal for removable attachment to a doctor blade assembly. The end seal comprises a seal body having a bottom wall, opposite first and second sidewalls and a top edge configured to include a radius adapted to align with and seal against a roller surface.

An abrasion resistant insert may be integrally secured within the seal body. The insert includes a bottom wall, opposite first and second sidewalls and a top edge configured to coincide with the body top edge so as to align with and seal against the roller surface. The seal body and abrasion resistant insert may each further comprise respective first and second upper angled sidewalls extending from respective opposite first and second sidewalls. The respective first and second upper angled sidewalls are aligned to engage in contacting relation with first and second doctor blades, respectively. The abrasion resistant insert may further include one or more holes wherein the seal body impregnates the holes. Further, one or both of the opposite first and second insert sidewalls may reside within and be encapsulated by the seal body. Alternatively or additionally, the insert bottom wall may also reside within and be encapsulated by the seal body. The abrasion resistant insert may have a thickness thinner than a width of the seal body such that the abrasion resistant insert is centrally located within the seal body. The abrasion resistant insert may be constructed of polyoxymethylene (POM) (also known as acetal), ultra-high-molecular-weight polyethylene (UHMWPE), polytetrafluoroethylene, a perfluoroalkoxy alkane or fluorinated ethylene propylene, or combinations thereof.

In another embodiment, more than one insert may be provided in the seal body in spaced, parallel relation to one another (e.g., two, three, four or more inserts). The provision of more than one insert provides added protection against leakage of fluid past the end seal in that if the first insert closest to the reservoir is compromised and fluid leaks past this first insert, the second insert which is adjacent the first insert will act as a back-up barrier to prevent further fluid leakage past the second insert, and so on should the second insert fail with end seals having more than two inserts.

The insert or inserts may be molded within the end seal or be inserted into a groove machined into an already formed seal. If desired, the insert may be press fit within the respective groove or further secured within the end seal groove using any known and appropriate means such as adhesive or ultrasonic welding, for example.

DETAILED DESCRIPTION

Figure 1:
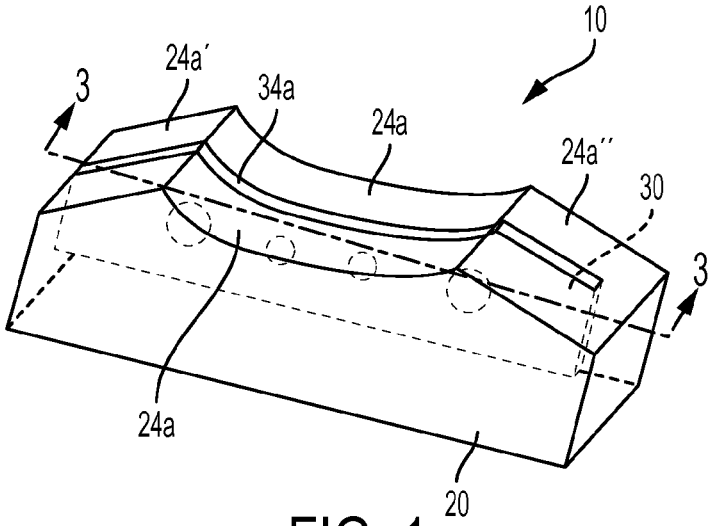
FIG. 1 is an enlarged perspective view of an embodiment of the inventive end seal.

Referring now to the drawing, there is seen in FIGS. 1-4 an embodiment of the inventive end seal designated generally by the reference numeral 10. Seal 10 includes a seal body 20 adapted to carry an integral abrasion resistant insert 30. Seal body 20 is preferably formed from a from a rigid yet resilient material (e.g., about 25-90 Durometer Shore A, more preferably about 60-80 Shore A, and yet more preferably about 70 Shore A) which may be injection or compression molded from an appropriate material such as, for example, thermoplastic materials or thermoset materials, EPDM rubber, Buna-N rubber, Natural Rubber, SBR Rubber, Viton, of a rubber compound that has been blended with performance enhancing additives having like characteristics, although other manufacturing processes are of course possible (e.g., cast molding, machining, SLA, vulcanization, vacuum molding, rapid prototyping, mechanical die cutting, water jet cutting, etc.). For the sake of simplicity, the material comprising body 20 will hereinafter be referred to as "rubber", although it is understood that any suitable material may be used as described above. Resident within seal body 20 is an insert 30. Insert 30 is preferably formed from an abrasion resistant material such as Teflon (polytetrafluoroethylene—PTFE), a perfluoroalkoxy alkane (PFA), fluorinated ethylene propylene (FEP), strip steel, biaxially-oriented polyethylene terephthalate (BoPET) (such as that sold under the trade name Mylar®), UHMWPE, POM (acetal) or other like materials. Again, for sake of simplicity, the material constructing insert 30 will be referred to as "Teflon" although it is understood that any alternative suitable material may be used.

Figure 2:
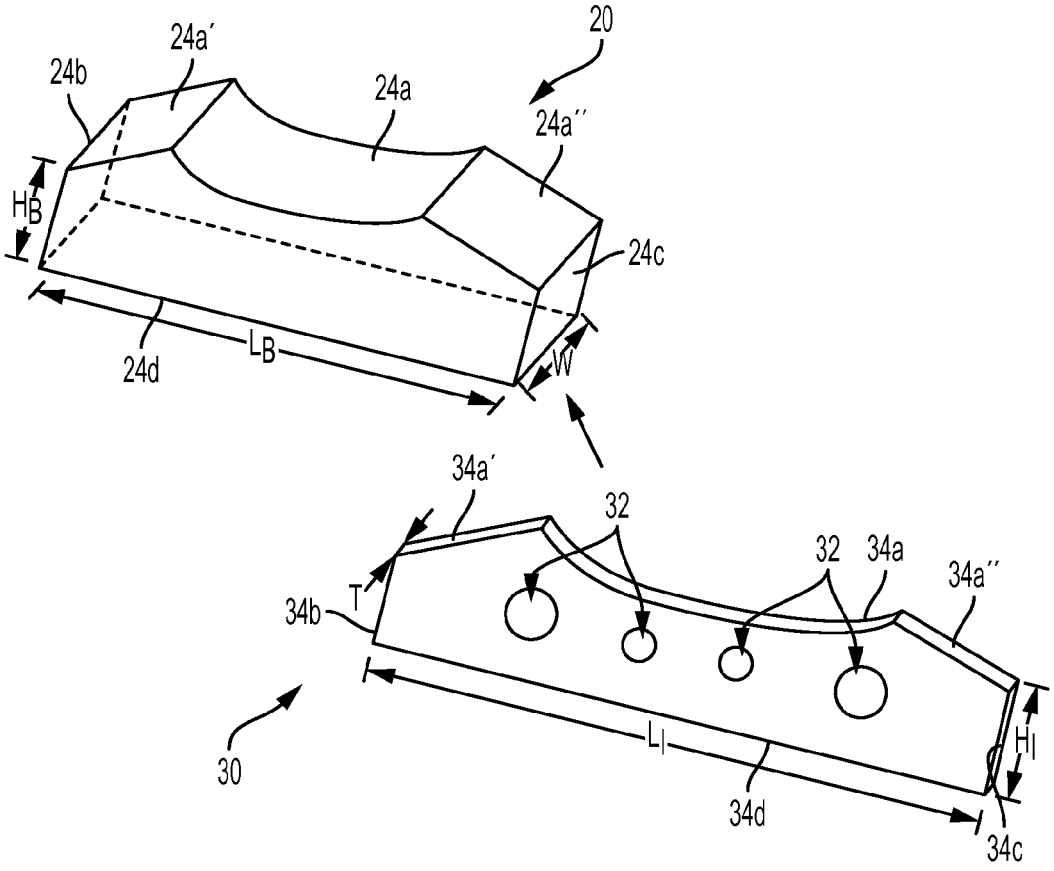
FIG. 2 is an exploded view of the end seal shown in FIG. 1.
Figure 3:
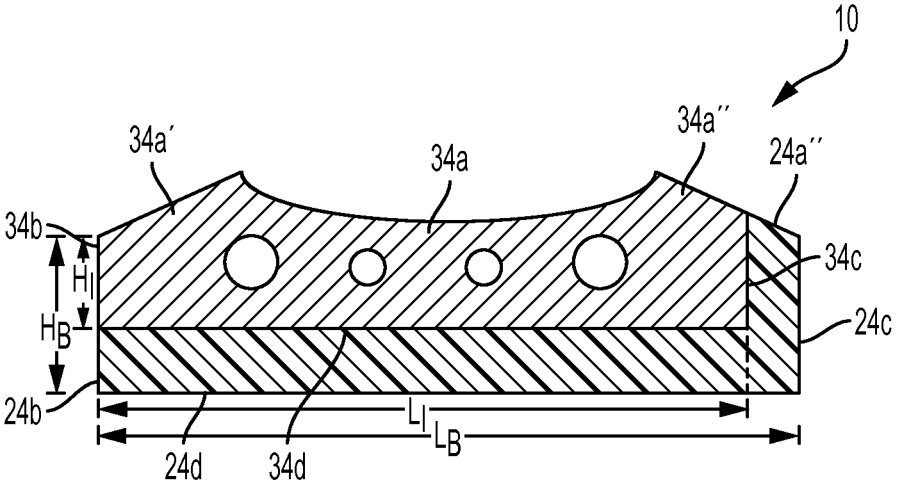
FIG. 3 is a cross-section view as taken generally along the line 3-3 in FIG. 1.
Figure 4:
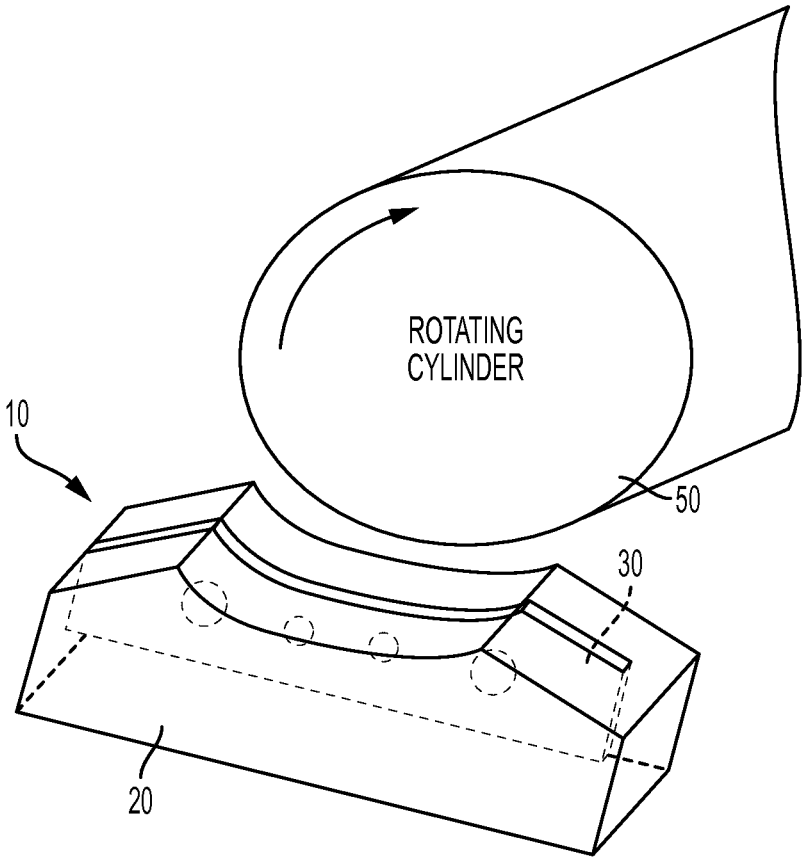
FIG. 4 is an exemplary end perspective view of the relation between the end seal shown in FIG. 1 and a corresponding roller.

In the presently preferred embodiment of an injection molded seal, as seen in FIGS. 1-4, abrasion resistant insert 30 is integrally formed within body 20. Insert 30 may include one or more holes 32 passing therethrough. Holes 32 allow the rubber material constituting body 20 to flow through the holes during manufacture thereby impregnating the holes 32 with rubber. The rubber impregnated holes ensure that the insert is positioned and anchored correctly within the seal 10. As a result, insert 30 is an integral and permanent component of the completed seal 10. The insert 30 will not lose its position within body 20, nor will it become dislodged or delaminated from the body 20 during operational rotation of the roller 50 (FIG. 4). The rubber material of body 20 residing with holes 32 of insert 30 further creates a suspension system for the insert. That is, the rubber body 20 provides the necessary compression/recovery properties that allow the abrasion resistant insert 30 to flex or otherwise absorb the mechanical tolerances inherent within the printing machine once the seal 10 is engaged against the rotating anilox roller 50 under pressure.

As seen best in FIG. 3, with combined reference to FIG. 2, seal body 20 is dimensioned to have a body width W and includes opposite body end walls 24*b* and 24*c* each having wall heights $H_B$ and a body bottom wall 24*d* defining a total body length $L_B$. The upper surface of seal body 20 includes a top radius edge 24*a* situated between opposite angled upper sidewalls 24*a*' and 24*a*". Upper sidewalls 24*a*' and 24*a*" each taper inwardly as they extend toward the center of seal 10 and are adapted to carry optional doctor blades (not shown) as is generally known in the art. Similarly, insert 30 is dimensioned to have an insert thickness T and includes opposite insert end walls 34*b* and 34*c* each having wall heights $H_I$ and an insert bottom wall 34*d* defining a total insert length $L_I$. The upper surface of insert 30 includes a top radius edge 34*a* situated between opposite angled upper sidewalls 34*a*' and 34*a*". Again, upper sidewalls 34*a*' and 34*a*" each taper inwardly as they extend toward the center of seal 10 and are adapted to carry optional doctor blades.

As seen in FIGS. 1, 3 and 4, insert 30 is positioned within body 20 such that top radius edge 34*a* of insert 30 is present at the radius edge 24*a* of body 20. As shown generally in FIG. 4, the combined top radius edges 24*a* and 34*a* are configured to be in intimate contact with rotating cylinder/roller 50. The thin surface of top radius edge 34*a* of insert 30 (as denoted by thickness "T" in FIG. 2) may act as a rotary doctor blade while the rubber portions of body radius edge 24*a* contact the rotating cylinder 50 on either side of insert 30 so as to provide two sealing surfaces to hold the ink/fluids within the enclosed chamber defined by opposing seals 10 in a fully assembled doctor blade assembly. The Teflon material of the abrasion resistant insert 30 wears more slowly than the rubber material constituting the remainder of end seal 10. In this manner, the frictional wear subjected to rubber body radius edge 24*a* is mitigated by insert top radius edge 34*a* of the abrasion resistant insert 30. This arrangement prolongs the operational lifetime of seal 10 while maintaining adequate liquid seals against rotating cylinder/roller 50.

With continued reference to FIG. 3, insert 30 has an insert length $L_I$ which is less than body length $L_B$ such that one or neither of insert sidewalls 34*b* or 34*c* is configured to coincide with body edge sidewalls 24*b* or 24*c*. In this manner, one or both of the insert sidewalls 34*b*/34*c* may be resident within and encapsulated by the rubber material comprising seal body 20. Similarly, insert 30 may have a sidewall height $H_I$ smaller than body height $H_B$ such that insert bottom wall 34*d* does not coincide with body bottom wall 24*d* but is terminated within and encapsulated by the rubber material comprising seal body 20. The encapsulation of either or both of the insert sidewalls 34*b*/34*c* and/or the insert bottom wall 34*d* provides compression/recovery properties that allow the abrasion resistant insert 30 to flex or otherwise absorb the mechanical tolerances inherent within the printing machine once the seal 10 is engaged against the rotating roller 50.

Figure 5A:
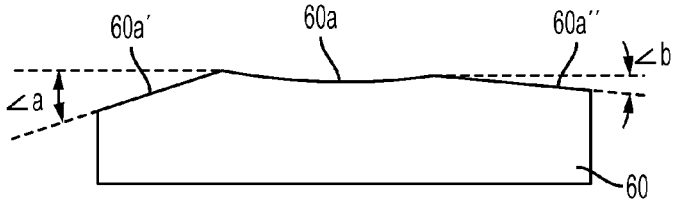
FIGS. 5A-C are two perspective views and a side elevational view, respectively, of another embodiment of seal.
Figure 5B:
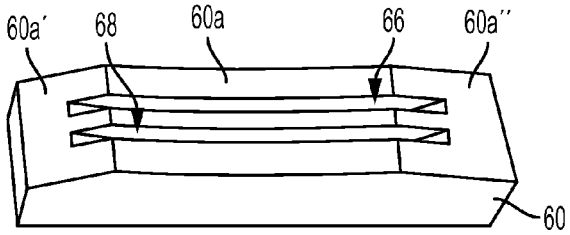
Figure 5C:
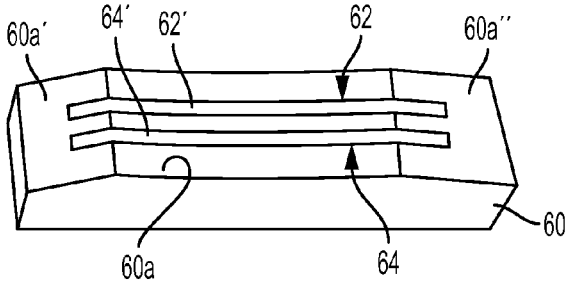

FIGS. 5A-5C show another embodiment of a seal body 60 having first and second abrasion resistant inserts 62, 64 positioned in spaced, parallel relation to each other at the top radius edge 60*a* situated between opposite angled upper sidewalls 60*a*' and 60*a*" (see FIG. 5C). The seal body upper sidewalls 60*a*' and 60" are dimensioned as needed to properly engage the relative positioning and geometry of the particular doctor blades used (not shown) which may or may not result in a symmetrical end seal. In the asymmetrical example of seal body 60, upper side walls 60*a*' and 60*a*" are shown to be of slightly different lengths with each tapering at a different angle "a" and "b" as they extend toward the center of seal 60, respectively (see FIG. 5A).

First and second inserts 62, 64 are either integrally molded into seal body 60 as explained above, or may be dimensioned to fit snugly within a cooperatively sized respective groove 66 and 68 machined or otherwise formed into seal body 60 (see FIG. 5B). Inserts 62, 64 may optionally be further secured in respective grooves 66, 68 using an adhesive or ultrasonic welding, for example.

As seen in FIG. 5C, first and second inserts 62, 64 are positioned within seal body 60 in the same manner as seal body 20 and insert 30, i.e., the exposed top radius edges 62', 64' of inserts 62, 64 are present at and preferably substantially flush with the radius edge surface 60*a* of body 60. If required for the particular application, inserts 62 and 64 may extend past radius edge surface 60*a* and into one or both of upper side walls 60*a*' and 60*a*" as shown.

Figure 6A:
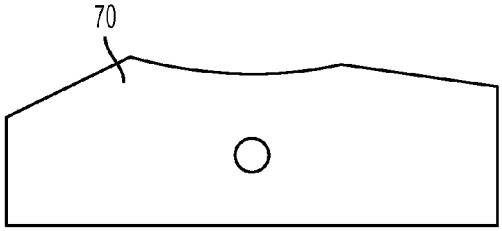
FIGS. 6A and 6B are perspective and side elevational views, respectively, of yet another embodiment of end seal.
Figure 6B:
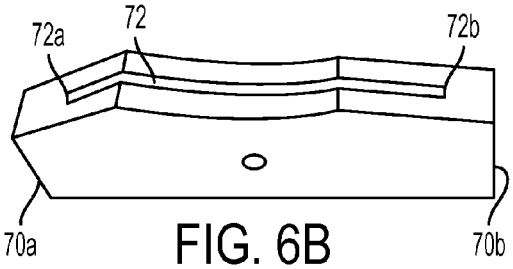

FIGS. 6A and 6B show another single insert embodiment having an asymmetrical seal body 70 and insert 72 having opposite ends 72*a*, 72*b* which are spaced from respective seal body end walls 70*a* and 70*b*.

Figure 7A:
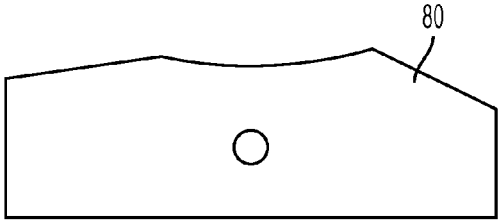
FIGS. 7A and 7B are perspective and side elevational views, respectively, of still another embodiment of end seal.
Figure 7B:
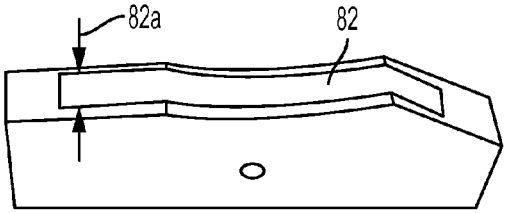

FIGS. 7A and 7B show yet another single insert embodiment having an asymmetrical seal body 80 and insert 82 having a thickness 82*a* which is larger than the inserts of the other embodiments. Insert 82*a* may be made from a fabric type material such as felt, for example, although it is understood that the inserts may be made of any desired synthetic or natural material and be of any number, thickness or length as appropriate for the particular machine application.

Although the invention has been described with reference to preferred embodiments thereof, it is understood that various modifications may be made thereto without departing from the full spirit and scope of the invention as defined by the claims which follow.

What is claimed is:

1. An end seal for removable attachment to a doctor blade assembly having first and second doctor blades configured to engage a roller surface, the end seal comprising:

a seal body having a bottom wall and opposite first and second sidewalls and a top edge configured to include a radius adapted to align with and seal against the roller surface; and at least one abrasion resistant insert formed from a material selected from a group consisting of polytetrafluoroethylene, polyoxymethylene, ultra-high-molecular-weight polyethylene, biaxially-oriented polyethylene terephthalate, a perfluoroalkoxy alkane, fluorinated ethylene propylene and combinations thereof, said at least one abrasion resistant insert secured to said seal body, said at least one abrasion resistant insert including a bottom wall and opposite first and second sidewalls and a top edge configured to coincide with said seal body top edge to align with and seal against a roller surface.

2. The seal of claim 1 wherein said seal body and said at least one abrasion resistant insert each further comprise respective first and second upper angled sidewalls extending from respective said opposite first and second sidewalls, said respective first and second upper angled sidewalls aligned to engage in contacting relation with first and second doctor blades, respectively.

3. The seal of claim 1 wherein said at least one abrasion resistant insert includes one or more holes wherein said seal body impregnates said holes.

4. The seal of claim 1 wherein one or both of said opposite first and second insert sidewalls resides within and is encapsulated by said seal body.

5. The seal of claim 1 wherein said insert bottom wall resides within and is encapsulated by said seal body.

6. The seal of claim 1 wherein said abrasion resistant insert has a thickness (T) thinner than a width (W) of said seal body wherein said abrasion resistant insert is centrally located within said seal body.

7. The seal of claim 1 and further comprising first and second abrasion resistant inserts secured in spaced, parallel relation to each other within said seal body.

8. An end seal for removable attachment to a doctor blade assembly having first and second doctor blades configured to engage a roller surface, the end seal comprising:

a seal body having a bottom wall and opposite first and second sidewalls and a top edge configured to include a radius adapted to align with and seal against the roller surface; and at least one abrasion resistant insert secured to said seal body, said at least one abrasion resistant insert including a bottom wall and opposite first and second sidewalls and a top edge configured to coincide with said seal body top edge to align with and seal against a roller surface, wherein said seal body and said at least one abrasion resistant insert each further comprise respective first and second upper angled sidewalls extending from respective said opposite first and second sidewalls, said respective first and second upper angled sidewalls aligned to engage in contacting relation with first and second doctor blades, respectively.

9. The seal of claim 8 wherein said at least one abrasion resistant insert includes one or more holes wherein said seal body impregnates said holes.

10. The seal of claim 8 wherein one or both of said opposite first and second insert sidewalls resides within and is encapsulated by said seal body.

11. The seal of claim 8 wherein said insert bottom wall resides within and is encapsulated by said seal body.

12. The seal of claim 8 wherein said abrasion resistant insert has a thickness (T) thinner than a width (W) of said seal body wherein said abrasion resistant insert is centrally located within said seal body.

13. The seal of claim 8 wherein said abrasion resistant insert is constructed of a material selected from the group consisting of polytetrafluoroethylene, polyoxymethylene, ultra-high-molecular-weight polyethylene, biaxially-oriented polyethylene terephthalate, a perfluoroalkoxy alkane, fluorinated ethylene propylene and combinations thereof.

14. The seal of claim 8 and further comprising first and second abrasion resistant inserts secured in spaced, parallel relation to each other within said seal body.

15. An end seal for removable attachment to a doctor blade assembly having first and second doctor blades configured to engage a roller surface, the end seal comprising:

a seal body having a bottom wall and opposite first and second sidewalls and a top edge configured to include a radius adapted to align with and seal against the roller surface; and at least one abrasion resistant insert secured to said seal body, said at least one abrasion resistant insert including a bottom wall and opposite first and second sidewalls and a top edge configured to coincide with said seal body top edge to align with and seal against a roller surface, wherein said at least one abrasion resistant insert includes one or more holes wherein said seal body impregnates said holes.

16. The seal of claim 15 wherein said seal body and said at least one abrasion resistant insert each further comprise respective first and second upper angled sidewalls extending from respective said opposite first and second sidewalls, said respective first and second upper angled sidewalls aligned to engage in contacting relation with first and second doctor blades, respectively.

17. The seal of claim 15 wherein one or both of said opposite first and second insert sidewalls resides within and is encapsulated by said seal body.

18. The seal of claim 15 wherein said insert bottom wall resides within and is encapsulated by said seal body.

19. The seal of claim 15 wherein said abrasion resistant insert has a thickness (T) thinner than a width (W) of said seal body wherein said abrasion resistant insert is centrally located within said seal body.

20. The seal of claim 15 wherein said abrasion resistant insert is constructed of a material selected from the group consisting of polytetrafluoroethylene, polyoxymethylene, ultra-high-molecular-weight polyethylene, biaxially-oriented polyethylene terephthalate, a perfluoroalkoxy alkane, fluorinated ethylene propylene and combinations thereof.

21. The seal of claim 15 and further comprising first and second abrasion resistant inserts secured in spaced, parallel relation to each other within said seal body.

22. An end seal for removable attachment to a doctor blade assembly having first and second doctor blades configured to engage a roller surface, the end seal comprising:

a seal body having a bottom wall and opposite first and second sidewalls and a top edge configured to include a radius adapted to align with and seal against the roller surface; and at least one abrasion resistant insert secured to said seal body, said at least one abrasion resistant insert including a bottom wall and opposite first and second sidewalls and a top edge configured to coincide with said seal body top edge to align with and seal against a roller surface, wherein said insert bottom wall resides within and is encapsulated by said seal body.

23. The seal of claim 22 wherein said seal body and said at least one abrasion resistant insert each further comprise respective first and second upper angled sidewalls extending from respective said opposite first and second sidewalls, said respective first and second upper angled sidewalls aligned to engage in contacting relation with first and second doctor blades, respectively.

24. The seal of claim 22 wherein said at least one abrasion resistant insert includes one or more holes wherein said seal body impregnates said holes.

25. The seal of claim 22 wherein one or both of said opposite first and second insert sidewalls resides within and is encapsulated by said seal body.

26. The seal of claim 22 wherein said abrasion resistant insert has a thickness (T) thinner than a width (W) of said seal body wherein said abrasion resistant insert is centrally located within said seal body.

27. The seal of claim 22 wherein said abrasion resistant insert is constructed of a material selected from the group consisting of polytetrafluoroethylene, polyoxymethylene, ultra-high-molecular-weight polyethylene, biaxially-oriented polyethylene terephthalate, a perfluoroalkoxy alkane, fluorinated ethylene propylene and combinations thereof.

28. The seal of claim 22 and further comprising first and second abrasion resistant inserts secured in spaced, parallel relation to each other within said seal body.

29. An end seal for removable attachment to a doctor blade assembly having first and second doctor blades configured to engage a roller surface, the end seal comprising:

a seal body having a bottom wall and opposite first and second sidewalls and a top edge configured to include a radius adapted to align with and seal against the roller surface; and a first and second abrasion resistant insert secured in parallel relation to each other to said seal body, said first and second abrasion resistant inserts each including a bottom wall and opposite first and second sidewalls and a top edge configured to coincide with said seal body top edge to align with and seal against a roller surface.

30. The seal of claim 29 wherein said seal body and said at least one abrasion resistant insert each further comprise respective first and second upper angled sidewalls extending from respective said opposite first and second sidewalls, said respective first and second upper angled sidewalls aligned to engage in contacting relation with first and second doctor blades, respectively.

31. The seal of claim 29 wherein said at least one abrasion resistant insert includes one or more holes wherein said seal body impregnates said holes.

32. The seal of claim 29 wherein one or both of said opposite first and second insert sidewalls resides within and is encapsulated by said seal body.

33. The seal of claim 29 wherein said insert bottom wall resides within and is encapsulated by said seal body.

34. The seal of claim 29 wherein said abrasion resistant insert has a thickness (T) thinner than a width (W) of said seal body wherein said abrasion resistant insert is centrally located within said seal body.

35. The seal of claim 29 wherein said abrasion resistant insert is constructed of a material selected from the group consisting of polytetrafluoroethylene, polyoxymethylene, ultra-high-molecular-weight polyethylene, biaxially-oriented polyethylene terephthalate, a perfluoroalkoxy alkane, fluorinated ethylene propylene and combinations thereof.

* * * * *